United States Patent [19]

Durston

[11] Patent Number: 4,559,067

[45] Date of Patent: Dec. 17, 1985

[54] PORTABLE AIR FILTRATION DEVICE

[75] Inventor: David S. Durston, Lichfield, England

[73] Assignee: Envirocor Limited, England

[21] Appl. No.: 588,044

[22] Filed: Mar. 9, 1984

[30] Foreign Application Priority Data

Mar. 12, 1983 [GB] United Kingdom ..... 8306853

[51] Int. Cl.[4] ..... B01D 46/02

[52] U.S. Cl. ..... 55/324; 55/356; 55/468; 55/483

[58] Field of Search ..... 55/321, 323, 356, 468, 55/480, 482, 483, 324

[56] References Cited

U.S. PATENT DOCUMENTS

| | | | |
|---|---|---|---|
| 1,658,114 | 2/1928 | Brunzel | 55/356 |
| 1,898,424 | 2/1933 | Collins | 55/483 |
| 3,362,141 | 1/1968 | Royster et al. | 55/468 |
| 4,277,264 | 7/1981 | Buchholz et al. | 55/482 X |
| 4,350,504 | 9/1982 | Diaehyk | 55/323 X |

FOREIGN PATENT DOCUMENTS

| | | |
|---|---|---|
| 718297 | 1/1953 | United Kingdom . |
| 779512 | 9/1955 | United Kingdom . |
| 823800 | 11/1956 | United Kingdom . |
| 1008677 | 12/1961 | United Kingdom . |
| 937312 | 3/1962 | United Kingdom . |
| 1110904 | 1/1966 | United Kingdom . |
| 1391373 | 3/1973 | United Kingdom . |
| 1435279 | 5/1974 | United Kingdom . |

*Primary Examiner*—Charles Hart

*Attorney, Agent, or Firm*—Leydig, Voit & Mayer, Ltd.

[57] ABSTRACT

A Coanda-type airmover 16 is mounted vertically on a hollow base 10 to draw air through the base from filtering means comprising a pre-filter 26 and an absolute (HEPA) filter 28. The airmover discharges the filtered air upwards. The two filters are stacked on the base for air to be drawn downwards through them from an inlet duct 30 leading horizontally from a contaminated-air inlet 32 of the device. An air tight cover 34 can be secured to cover the inlet 32 of the duct when the equipment is not in use, enabling contaminated filters to be left in place during transportation. The portable device may be used for withdrawing and cleaning fibre-laden air from a working space where asbestos stripping is taking place.

7 Claims, 2 Drawing Figures

PORTABLE AIR FILTRATION DEVICE

DESCRIPTION OF INVENTION

Figure 1:
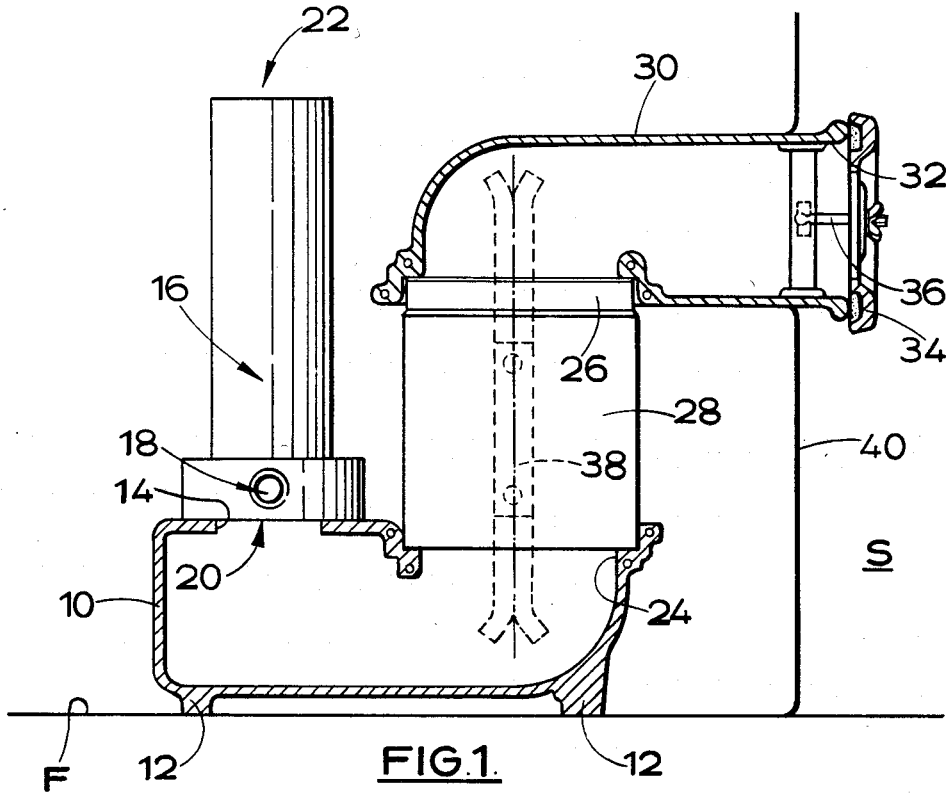

Asbestos fibres in the air can present a serious health hazard, and suitable filtration equipment in various forms has been developed for use in withdrawing and cleaning fibre-laden air from a working space. Problems may be particularly acute during stripping off operations, where old asbestos is removed forcibly from, for example, pipes or steelwork, and because of the nature of the operation a lot of loose fibres become free in the air. To prevent the escape of fibres from a working space, other than through the filtration equipment, suitable equipment should be capable of reducing the pressure in the working space, in order that all unfiltered air flows are into the space.

One known kind of equipment which was developed specially for this work is in the form of a large mobile unit adapted to stand outside a building and by means of high vacuum (created by a multi-stage fan) to draw fibre-laden air from a working space in the building through a pipe. Large quantities of fibre can so be collected. However, that kind of equipment is not really suitable for smaller jobs, where one would wish to have the equipment positioned within a building close to the working space, and for those purposes electrically powered equipment has been used which can be split up into portable sections (e.g. motor, fan, filters, etc.) and reassembled within the building. However, that equipment is cumbersome and, owing not least to the weight of its motor, does not adequately fulfill the common need for lightweight, efficient, readily portable, equipment; such equipment should be readily carryable, preferably without disassembly, up ladders and scaffolding if necessary by not more than two men. Such relatively lightweight electrical equipment as has become available is generally too low-powered to be widely useful.

It is an object of the present invention to provide a portable air filtration device suitable for use in withdrawing and cleaning contaminated air from a working space.

The invention provides in one of its aspects a portable air filtration device comprising an airmover arranged to draw contaminated air from a working space through filtering means of the device.

By an "airmover" is meant the Coanda type air pump which can operate to draw a secondary air stream into and through itself through the agency of a high velocity primary air stream which entrains the secondary air and exhausts it through an outlet against atmospheric pressure.

The necessary supply of compressed air, for operation of the airmover, can come from a compressor at a remote location. The filtering means may suitably comprise a high efficiency particulate air (HEPA) filter (a so-called absolute filter).

We have found that the use of an airmover can enable the device to be capable of efficiently filtering contaminated air from a working space (during, for example, asbestos stripping operations within a building) and yet be sufficiently light and compact to require not more than two men to carry it. Certain other advantages can also arise from the use of an airmover: (i) the equipment can be without moving parts, giving benefits as regards robustness, ease of maintenance, and safety; (ii) the air flow can be readily adjustable to suit site conditions; (iii) the equipment can be without any electrical components, making it non-sparking and so suitable for use in low-flash areas (e.g. in refineries); and (iv) where piped compressed air is available on site, no further compressor or power source may be needed.

In a preferred construction, the airmover is arranged upright (when the device is in its normal orientation for use), i.e. with its exhaust outlet directed upwards; a diffuser, which can serve also as an acoustic enclosure, may be mounted above and around the outlet. The airmover may be mounted on a base which provides an interconnecting air passage between an inlet of the airmover and an outlet end of the filtering means; the base may simply be in the form of a hollow body. Preferably the filtering means is also arranged upright on the base, which is to say that it is arranged for air to be drawn downwards through it, and an inlet duct may lead generally horizontally from a position adjacent to (above) the filtering means to an inlet for contaminated air. Either or both of the base and the duct may be of a reinforced plastics material (e.g. fibreglass) for strength with lightness.

There now follows a detailed description, to be read with reference to the accompanying drawings, of a portable air filtration device which illustrates the invention by way of example.

Figure 2:
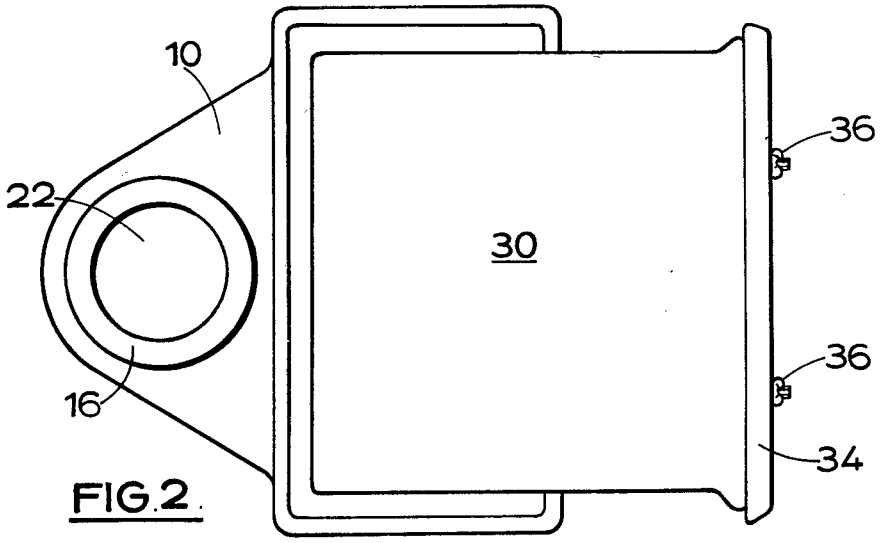

In the accompanying drawings:

FIG. 1 is partially sectional, elevational, view of the device shown installed for use; and FIG. 2 is a top plan view of the device.

The device, which is suitable for use in removing asbestos fibres from air from a working space S, comprises a base 10 in the form of a hollow body of fibreglass. The base comprises three feet 12 by means of which it can stand on a level floor F.

Secured to the base 10, above a first opening 14 in an upper wall of the base, is a generally cylindrical airmover 16 of the Coanda type; the air mover 16 is mounted with its axis vertical. The airmover comprises a radially directed primary air inlet 18 for compressed air from a remote compressor, an axially directed secondary air inlet 20 for air which will be drawn from the base 10 through the opening 14, and at its top end an axially upwards directed exhaust air outlet 22. The airmover 16 is one marketed in the U.K. as a JET-FLOW AIRMOVER (Registered Trade Mark).

Also secured to the base 10, above a second opening 24 in the upper wall of the base, is a double filter arrangement of filtering means comprising a pre-filter 26 on top of an absolute (HEPA) filter 28, the two being stacked vertically for air to be drawn downwards through them and through the opening 24 into the body 10. The hollow base 10 so provides an interconnecting air passage between an outlet end of the filtering means and the secondary air inlet 20 of the airmover 16.

An inlet duct 30 of fibreglass is mounted on the pre-filter 26 and leads horizontally from a position adjacent to (above) an inlet end of the filtering means to a contaminated-air inlet 32. A removable air-tight cover 34 is secured to the duct 30 by means of bolt and wing-nut fastenings 36 to close the inlet 32 when the device is not in use; this enables contaminated filters to be left in place whilst the device is moved from site to site. It is to be observed that readily damaged filtering elements of the filters 26 and 28 are substantially inaccessible without removal of the duct 30 or base 10, and furthermore the pre-filter 26 protects the absolute filter 28 from above.

Releasable strapping 38 secures together the duct 30, the filters 26 and 28, and the base 10. Seals (not shown) between the duct 30 and the pre-filter 26, and between the pre-filter and the absolute filter 28, preclude any possible escape of contaminated air from the device. In use of the device reduced pressure in the duct 30 would draw clean air from outside the device into the duct should the seals fail.

When the device is installed for use (see FIG. 1) it stands in a clean air region outside the working space S save for an inlet end portion of the duct 30 which is within the space; an impervious sheet 40, sealed around the duct 30 and to the floor F, separates the working space S from the clean air region. (Alternatively, of course, a duct extension pipe may be fitted to lead similarly from the working space). To operate the device, the cover 34 is removed from the duct 30 to expose the inlet 32 within the working space, and an air supply pipe from a remote compressor is connected up to the primary air inlet 18 of the airmover 16. By means of a regulator (not shown) the compressed air supply to the airmover 16 is controlled to give the required vacuuming effect, and contaminated air so becomes drawn by the airmover through the inlet 32 of the duct 30, along the duct to the filtering means, and down through the filters 26 and 28. Furthermore, the device serves to reduce the pressure in the working space S, to ensure that all air flows other than that through the duct 30 are in a direction into the space S. The filters separate substantially all asbestos fibre from the air, and the cleaned air passes through the interconnecting air passage provided by the base 10, and upwards through the airmover 16 by way of the secondary air inlet 20 and the outlet 22.

The device is light and readily portable by two men.

The filters 26 and 28 can be changed when necessary upon releasing the strapping 38 and removing the duct 30, conventional safeguards being observed to prevent the release of fibres into a clean air region.

I claim as my invention:

1. A portable air filtration device suitable for use in drawing off and cleaning contaminated air from a working space comprising a base defining an air passageway therein; an airmover mounted on top of one side of said base; said airmover having an air inlet in an underside thereof in communication with said base passageway, a second air inlet disposed transversely to said air inlet for coupling to a remote compressed air source, and an air outlet disposed above said air inlets for discharging filtered air to the atmosphere; filtering means mounted on top of said base on a side opposite said airmover; said filtering means having an air inlet side and an air outlet side; said filtering means outlet side being in communication with said base air passageway; an inlet duct in communication with said filter means inlet side; and fastening means for retaining said filtering means between said base and inlet duct, whereby in operation of the device with said inlet duct in communication with a working space said airmover draws contaminated air from the working space through said inlet duct, said filtering means and said base air passageway and exhausts cleaned air to atmosphere.

2. A device according to claim 1 in which said airmover is moutned on said base with its exhaust outlet directed upwards.

3. A device according to claim 2 in which said filtering means is mounted on said base such that air from said inlet duct flows downwardly through said filter means.

4. A device according to claim 3 in which said inlet duct is fastened in generally horizontally extending relation to said filtering means.

5. A device according to claim 3 including an airtight cover which can be secured to said duct to close said contaminated-air inlet when the device is not in use, so permitting said filtering means even when contaminated to be left in place whilst the device is transported.

6. A device according to claim 1 in which said filtering means comprises an absolute (HEPA) filter.

7. A device according to claim 6 in which said filtering means comprises also a pre-filter.

* * * * *